US008365798B2

(12) United States Patent
Feldpausch et al.

(10) Patent No.: US 8,365,798 B2
(45) Date of Patent: Feb. 5, 2013

(54) PRIVACY SCREEN ASSEMBLY

(75) Inventors: Thomas G. Feldpausch, Hastings, MI (US); Adrian Gomez, Hoboken, NJ (US); Allen C. Hager, Grand Rapids, MI (US); Kurt R. Heidmann, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 399 days.

(21) Appl. No.: 12/470,523

(22) Filed: May 22, 2009

(65) Prior Publication Data

US 2009/0294078 A1 Dec. 3, 2009

Related U.S. Application Data

(60) Provisional application No. 61/056,273, filed on May 27, 2008.

(51) Int. Cl.
*E06B 3/94* (2006.01)

(52) U.S. Cl. ..... 160/84.06; 160/84.04; 160/172 R; 160/351; 160/135

(58) Field of Classification Search ..... 160/34, 160/84.06, 24, 135, 351, 84.01
See application file for complete search history.

(56) References Cited

U.S. PATENT DOCUMENTS

| | | | | |
|---|---|---|---|---|
| 193,573 | A | 7/1877 | Tripp | |
| 354,450 | A * | 12/1886 | Tripp | 160/327 |
| 376,436 | A | 1/1888 | Harrison | |
| 388,161 | A | 8/1888 | Tripp | |
| 684,130 | A | 10/1901 | Taubert | |
| 1,009,722 | A | 11/1911 | Corbitt | |
| 1,222,805 | A | 4/1917 | Schmid | |
| 1,655,515 | A * | 1/1928 | Simpson | 160/19 |
| 1,706,388 | A | 3/1929 | Ashkenas | |
| 2,425,466 | A | 8/1947 | Gregory | |
| 2,874,770 | A | 2/1959 | Rohr et al. | |
| 2,911,038 | A | 11/1959 | Frommelt | |
| 3,017,969 | A | 1/1962 | Nielsen | |
| 3,187,761 | A | 6/1965 | De Maio | |
| 3,220,464 | A | 11/1965 | Wise | |
| 3,223,147 | A | 12/1965 | Holloway | |
| RE26,156 | E | 2/1967 | Muller | |
| 3,592,289 | A | 7/1971 | Aysta | |
| 3,768,222 | A | 10/1973 | Birum, Jr. | |
| 3,871,153 | A | 3/1975 | Birum, Jr. | |
| 3,875,711 | A | 4/1975 | Palmer | |

(Continued)

FOREIGN PATENT DOCUMENTS

| | | |
|---|---|---|
| GB | 1304727 | 1/1973 |
| WO | 2004020235 A2 | 3/2004 |

(Continued)

*Primary Examiner* — Blair M. Johnson
(74) *Attorney, Agent, or Firm* — Price Heneveld LLP

(57) ABSTRACT

A privacy screen assembly has a first elongated support, a second elongated support, and a privacy screen having a first end operably coupled with the first elongated support and a second end operably coupled to the second elongated support, wherein the first privacy screen is positionable between a retracted position and a deployed position. A support member vertically supports the privacy screen and is positionable between a retracted position, wherein the support member is stored within an interior of one of the first elongated support and the second elongated support in a substantially linear configuration, and a deployed position, wherein a substantial portion of the support member extends from the interior of the elongated support and wherein a substantial portion of the support member exits the interior of the elongated support such that less of the support member is present in the interior of the elongated support.

20 Claims, 17 Drawing Sheets

U.S. PATENT DOCUMENTS 3,889,736 A 6/1975 Firks
4,121,645 A 10/1978 Behr
4,123,820 A 11/1978 Hamilton
D257,811 S 1/1981 Ball
4,516,620 A 5/1985 Mulhern
4,606,394 A 8/1986 Bannister
4,707,018 A 11/1987 Gavagan
4,750,586 A 6/1988 Lerner et al.
4,758,042 A 7/1988 Liu
4,825,921 A 5/1989 Rigter
4,862,942 A 9/1989 Johnson
4,928,465 A 5/1990 Del Castillo Von Haucke
4,932,711 A 6/1990 Goebel
4,947,601 A 8/1990 McGuire
D312,177 S 11/1990 Walter
4,969,500 A 11/1990 Makosa
D314,482 S 2/1991 Walter et al.
D315,651 S 3/1991 Citterio et al.
5,050,846 A 9/1991 Goodman et al.
5,058,331 A 10/1991 Epps
5,067,541 A 11/1991 Coslett
5,076,633 A 12/1991 Hsu et al.
5,214,885 A 6/1993 Maas et al.
5,272,848 A 12/1993 Maas
5,301,733 A * 4/1994 Toti ..... 160/84.01
5,323,834 A 6/1994 Toti
5,351,737 A * 10/1994 Hoshiyama ..... 160/84.03
D352,399 S 11/1994 Goodwin
5,365,991 A 11/1994 Wright
5,402,999 A 4/1995 Keehn, Sr.
D358,662 S 5/1995 Good
5,477,904 A * 12/1995 Yang ..... 160/370.23
5,486,391 A 1/1996 Tyner
5,502,930 A 4/1996 Burkette
D382,390 S 8/1997 Hambleton et al.
5,675,946 A 10/1997 Verbeek et al.
5,689,926 A 11/1997 Nichols
D387,927 S 12/1997 Canton Gongora et al.
5,745,932 A 5/1998 Barovetto
D395,365 S 6/1998 Verbeek et al.
5,775,034 A 7/1998 Logue
D399,063 S 10/1998 Verbeek et al.
5,873,401 A * 2/1999 Tsuchida ..... 160/84.04
5,875,597 A 3/1999 Gingrich et al.
5,906,420 A 5/1999 Rozier, Jr. et al.
5,947,544 A 9/1999 Hubeshi
5,966,879 A 10/1999 Verbeek et al.
D415,901 S 11/1999 Arko
6,012,504 A 1/2000 Siegal
D420,223 S 2/2000 Chipman et al.
D422,796 S 4/2000 Milligan et al.
6,089,301 A 7/2000 Smith
6,116,326 A 9/2000 Domina
6,142,701 A 11/2000 Falcon
6,152,205 A 11/2000 Toti
6,186,212 B1 * 2/2001 Tsuchida ..... 160/84.06
6,213,191 B1 4/2001 Nitzche
6,249,377 B1 6/2001 Takamoto et al.
D445,273 S 7/2001 Brown et al.
D446,028 S 8/2001 Ruedinger et al.
6,293,328 B1 9/2001 Fremont
6,309,076 B1 10/2001 McVicker
6,354,043 B1 3/2002 Simon et al.
6,374,547 B1 4/2002 Baloga et al.
6,378,592 B1 4/2002 Kimmet
D457,359 S 5/2002 Chan
D457,737 S 5/2002 Citterio
D458,040 S 6/2002 Stannis
D458,041 S 6/2002 Couture
D458,463 S 6/2002 Citterio
D460,630 S 7/2002 Ritch et al.
6,415,553 B1 7/2002 Krayer, Jr. et al.
6,450,233 B1 9/2002 Becker
6,516,571 B1 2/2003 Overthun et al.
6,533,017 B1 3/2003 Toti
6,552,850 B1 4/2003 Dudasik
6,622,771 B2 9/2003 Plockmeyer
6,648,047 B2 11/2003 Kimmet
6,732,660 B2 5/2004 Dame et al.
6,896,028 B2 5/2005 Brennan
6,978,820 B2 12/2005 Aoki
D515,033 S 2/2006 Petrick et al.
D515,034 S 2/2006 Petrick et al.
D527,917 S 9/2006 McHugh
7,168,131 B2 1/2007 Ruggiero
7,217,061 B2 5/2007 Stratton
7,222,655 B2 5/2007 Toti
7,231,954 B2 6/2007 Green
7,237,591 B2 7/2007 Snyder et al.
D559,565 S 1/2008 Bakker et al.
D595,514 S * 7/2009 Feldpausch et al. ..... D6/332
D599,122 S * 9/2009 Feldpausch et al. ..... D6/332
2002/0043352 A1 4/2002 Stannis et al.
2002/0084042 A1 7/2002 Kimmet
2003/0051832 A1 3/2003 Plockmeyer
2004/0140066 A1 7/2004 Brennan
2005/0000168 A1 * 1/2005 Wright ..... 52/36.1
2006/0060310 A1 3/2006 Haugen
2007/0000620 A1 1/2007 Colson et al.
2007/0267152 A1 * 11/2007 Fan ..... 160/84.06
2009/0294078 A1 * 12/2009 Feldpausch et al. ..... 160/377

FOREIGN PATENT DOCUMENTS

WO 2007027650 A1 3/2007

* cited by examiner

PRIVACY SCREEN ASSEMBLY

CROSS REFERENCE TO RELATED APPLICATION

This application claims benefit under 35 U.S.C. §119(e) of provisional application Ser. No. 61/056,273, filed May 27, 2008, entitled DEPLOYABLE PRIVACY SCREEN ASSEMBLY, the entire contents of which are incorporated herein in its entirety.

BACKGROUND OF THE INVENTION

The present invention relates to privacy screens and the like, and in particular, to privacy screens for use in office systems.

SUMMARY OF THE INVENTION

One aspect of the present invention includes a privacy screen assembly including a first elongated support, a second elongated support and a privacy screen having a first end operably coupled with the first elongated support and a second end operably coupled to the second elongated support, wherein the privacy screen is positionable between a retracted position and a deployed position. A support member is operably coupled with the privacy screen such that the privacy screen is vertically supported by the support member. The support member is positionable between a retracted position, wherein the support member is stored within an interior of a select one of the first elongated support and the second elongated support in a substantially linear configuration, and a deployed position, wherein a substantial portion of the support member extends from the interior of the select one of the first elongated support and the second elongated support and wherein a substantial portion of the support member exits the interior of the select one of the first elongated support and second elongated support such that less of the support member is present in the interior of the select one of the first elongated support and second elongated support than when the support member is in the retracted position.

Another aspect of the present invention includes a privacy screen assembly that has a first elongated support having a first base adapted to support the first elongated support from a floor surface and a second elongated support having a second base adapted to support the second elongated support from a floor surface and having a cavity for receiving at least a portion of the first elongated support therein. The privacy screen assembly further includes a first privacy screen having a first end operably coupled with the first elongated support, and a second end operably coupled to the second elongated support, wherein the privacy screen is positionable between a retracted position and a deployed position.

Another aspect of the present invention includes a privacy screen assembly having a first elongated support and a privacy screen including a first end and a second end, wherein the first end is removably connected to the first elongated support and wherein the privacy screen is positionable between a retracted position and a deployed position. The privacy screen assembly further includes a second elongated support connected to the second end of the privacy screen, a support member assembly including a first support member slidably engaged with the privacy screen and having a substantial portion thereof stored in a vertical linear orientation when the privacy screen is in the retracted position, and a second support member slidably engaged with the privacy screen and having a substantial portion thereof stored in a vertical linear orientation when the privacy screen is in the retracted position.

Yet another aspect of the present invention includes, in a screen assembly having an extendable and retractable screen extending from an elongated vertical support, the improvement of a support member storage device including a support member slidably connected with the privacy screen and being positionable between a linear retracted position inside the elongated vertical support and a linear deployed position outside the elongated vertical support. A first directional translator is connected to the elongated vertical support that is slidingly engaged with the support member and configured to translate the support member from the linear retracted position to the linear deployed position.

These and other features, advantages and objects of the present invention will be further understood and appreciated by those skilled in the art upon studying the following specification, claims, and appended drawings.

DETAILED DESCRIPTION OF PREFERRED EMBODIMENTS

Figure 1:
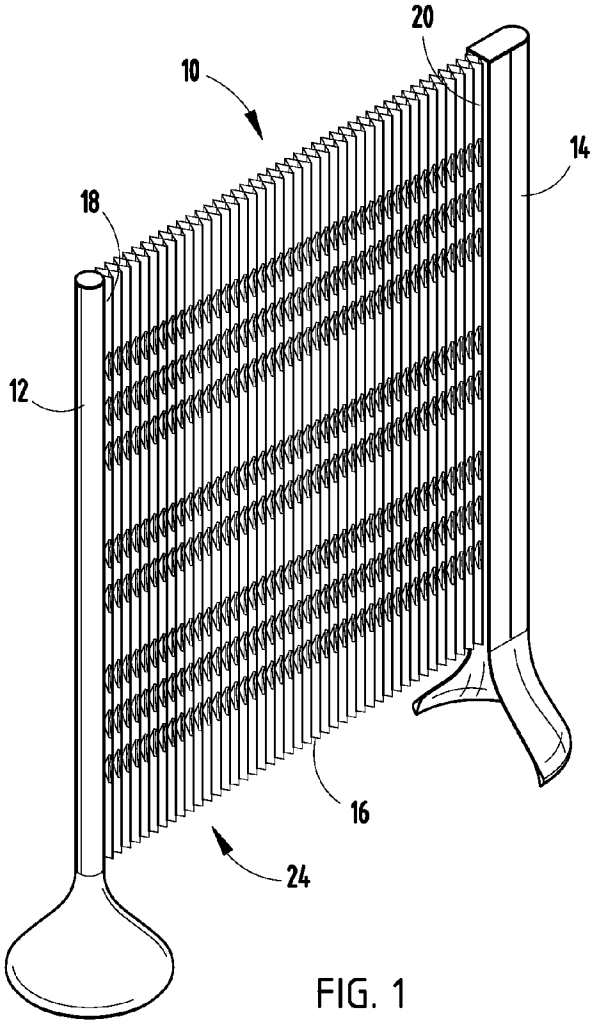
FIG. 1 is a top perspective view of one embodiment of a privacy screen assembly of the present invention with the privacy screen deployed.
Figure 5:
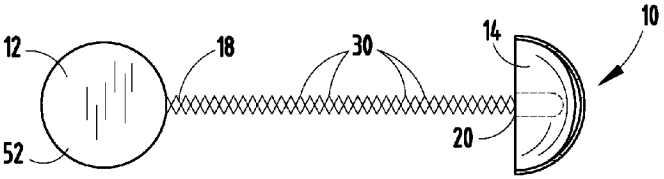
FIG. 5 is a bottom elevational view of the privacy screen assembly of FIG. 1.
Figure 7:
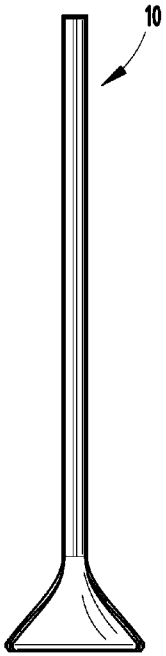
FIG. 7 is a front side elevational view of the privacy screen assembly of FIG. 1.
Figure 6:
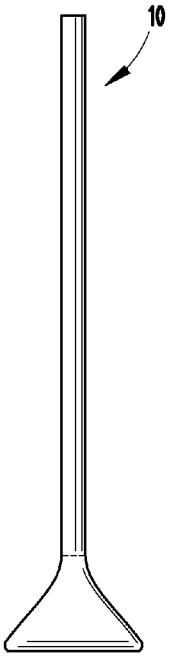
FIG. 6 is a rear side elevational view of the privacy screen assembly of FIG. 1.

For purposes of description herein, the terms "upper," "lower," "right," "left," "rear," "front," "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
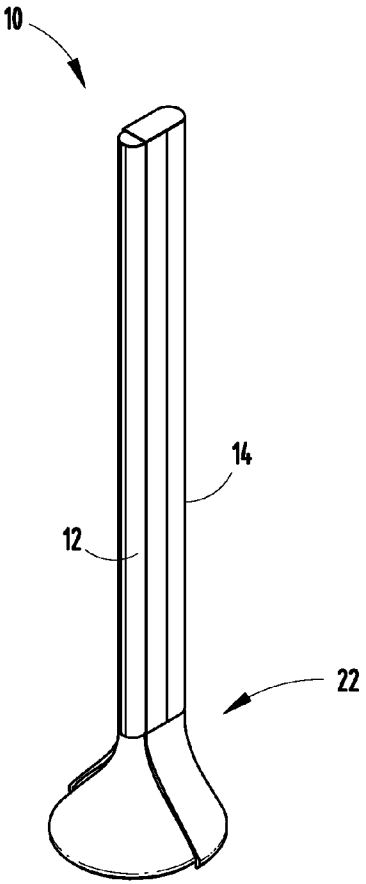
FIG. 2 is a top perspective view of the privacy screen assembly of FIG. 1, with the privacy screen retracted.
Figure 3:
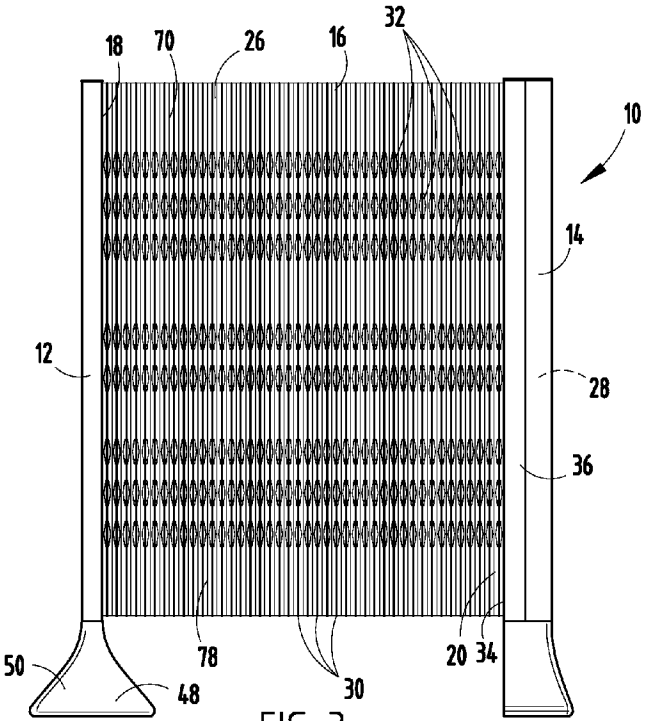
FIG. 3 is side elevational view of the privacy screen assembly of FIG. 1.
Figure 4:
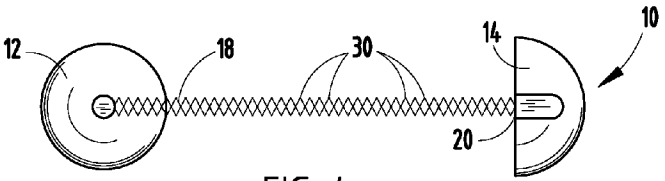
FIG. 4 is a top elevational view of the privacy screen assembly of FIG. 1.
Figure 11:
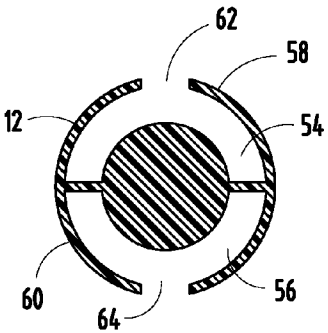
FIG. 11 is a cross-sectional view of the first elongated support taken at lines XI-XI of FIG. 10.
Figure 10:
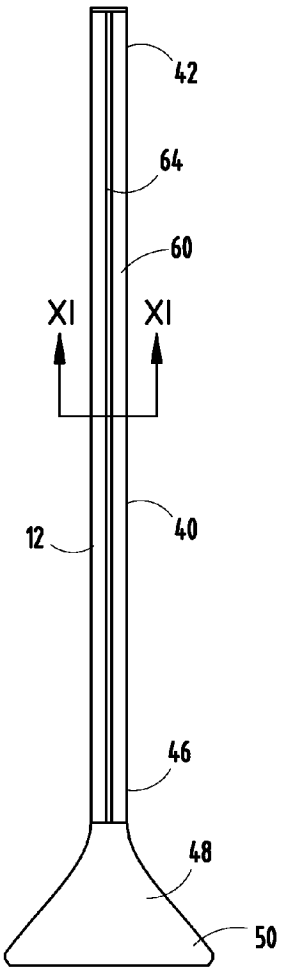
FIG. 10 is a side elevational view of the first elongated support of FIG. 8.
Figure 9:
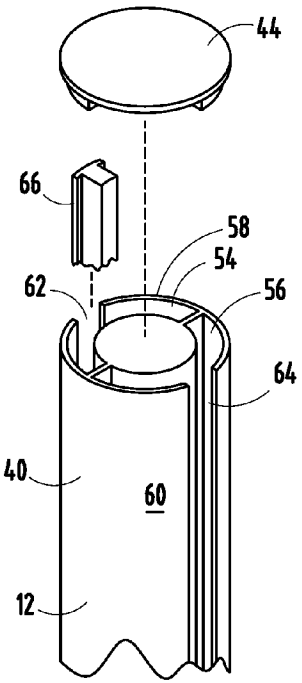
FIG. 9 is a partial top perspective view of the first elongated support of FIG. 8.
Figure 8:
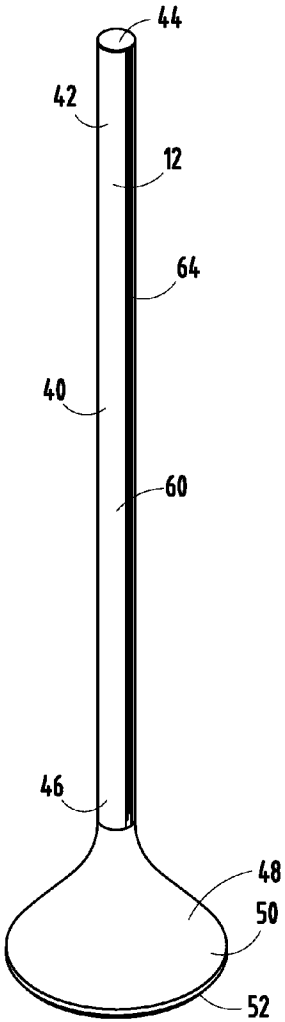
FIG. 8 is a top perspective view of a first elongated support.

As shown in FIGS. 1 and 2, the reference numeral 10 generally designates a privacy screen assembly having a first elongated support 12 and a second elongated support 14. A first privacy screen 16 has a first end 18 operably coupled with the first elongated support 12 and a second end 20 operably coupled to the second elongated support 14. The first privacy screen 16 is positionable between a retracted position 22 (FIG. 2) and a deployed position 24 (FIG. 1). A first support member 26 (FIG. 3) is operably coupled with the first privacy screen 16 such that the first privacy screen 16 is vertically supported by the first support member 26. The first support member 26 is positionable between a retracted position 22, wherein the first support member 26 is stored within an interior 28 of a select one of the first elongated support 12 and the second elongated support 14 in a substantially linear configuration, and a deployed position 24, wherein a substantial portion of the first support member 26 extends from the interior 28 of the select one of the first elongated support 12 and the second elongated support 14 and wherein a substantial portion of the first support member 26 exits the interior 28 of the select one of the first elongated support 12 and second elongated support 14 such that less of the first support member 26 is present in the interior 28 of the select one of the first elongated support 12 and the second elongated support 14.

Referring now to FIGS. 3-7, the privacy screen includes a multitude of pleats 30 that form a three-dimensional, accordion-like construction that compresses in the retracted position 22 and expands in the deployed position 24, although it is conceived that the first privacy screen 16 could have a two-dimensional planar construction. The first privacy screen 16 may have one or more aesthetic openings 32 arranged in the pleats 30. The second end 20 of the first privacy screen 16 is fixedly attached to a forward side 34 of a casing 36 on the second elongated support 14. The first end 18 includes a stiffened spine 38 (FIG. 12) discussed in further detail below.

Referring now to FIGS. 8-11, the first elongated support 12 includes a vertical pole 40 having a top end 42 with a cap 44 and a bottom end 46 that extends into and is engaged with a base 48 having a conical exterior 50. The base 48 includes a circular footprint 52 (FIGS. 4 and 5) and is weighted such that the first elongated support 12 and the first privacy screen 16 may be placed in a fully deployed position 24 and the weight of the first privacy screen 16 will not tip or otherwise cause to fall the first elongated support 12. The vertical pole 40 includes first and second C-shaped channels 54, 56 extending on first and second sides 58, 60 of the pole 40. The C-shaped channels 54, 56 extend along a substantial portion of the longitudinal extent of the vertical pole 40 and terminate at the top end 42 of the vertical pole 40 and where the vertical pole 40 connects with the base 48. Each of the C-shaped channels 54, 56 opens outwardly through longitudinal slots 62, 64. When one of the C-shaped channels 54, 56 is not being used, a filler 66 can be inserted into the unused C-shaped channel 54, 56, which causes the external circumference of the vertical pole 40 to appear relatively seamless. The stiffened spine 38 (FIG. 12) is located on the first end 18 of the first privacy screen 16 and is designed for insertion into one of the C-shaped channels 54, 56 of the first elongated support 12. The slots 62, 64 extending from each of the C-shaped channels 54, 56 allow the first end 18 of the first privacy screen 16 to extend outward from the C-shaped channels 54, 56 toward the second elongated support 14.

Figure 12:
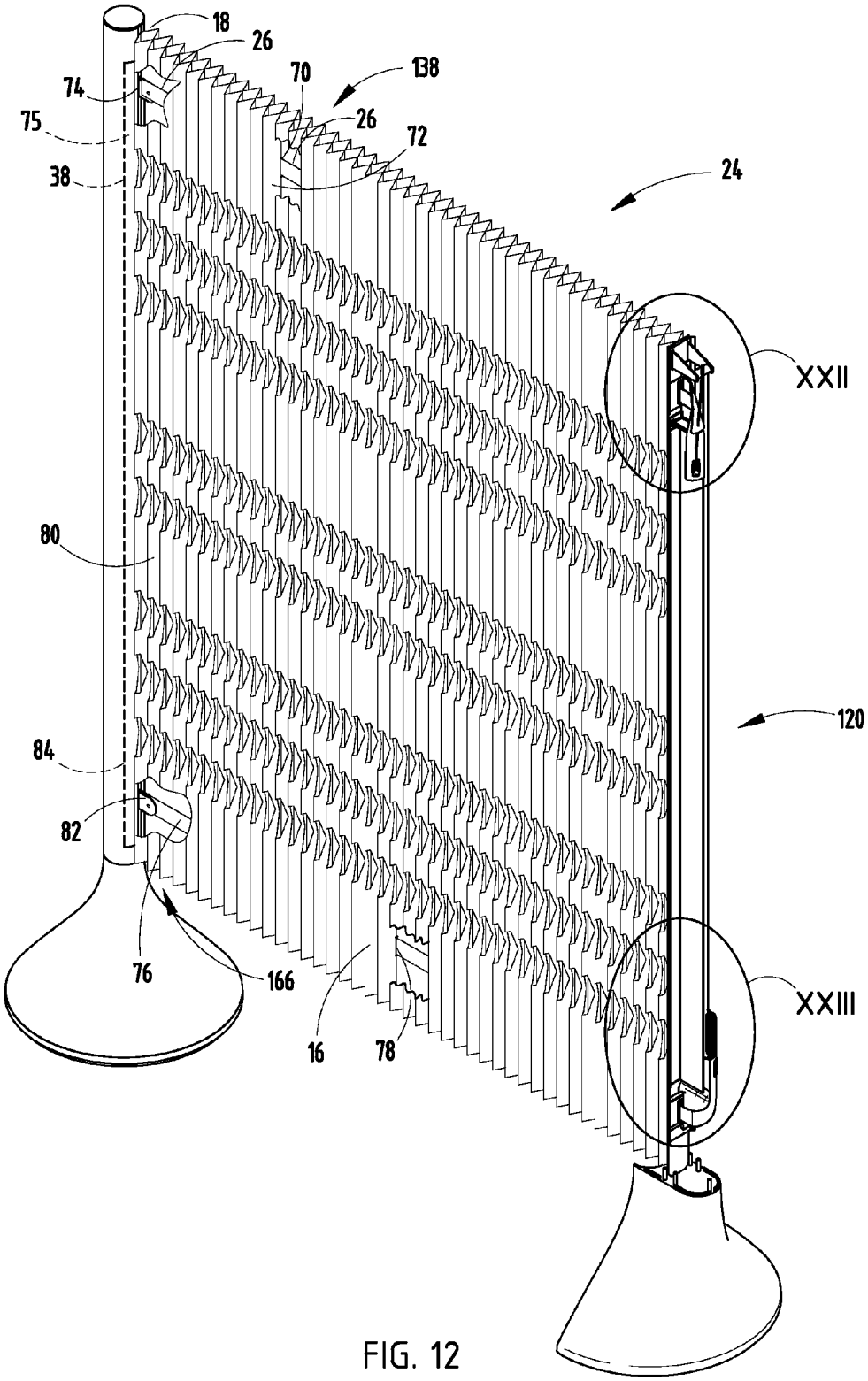
FIG. 12 is a partial top perspective view of the privacy screen assembly of the present invention.

As shown in FIG. 12, the first support member 26 is interwoven through slits 70 that extend through the latticework of the first privacy screen 16 at a top portion 72 thereof. A first end 74 of the first support member 26 is secured to an upper end 75 of the stiffened spine 38 such that the first support member 26 provides support to the first privacy screen 16 when in the deployed position 24. Likewise, a second or lower support member 76 extends from the second elongated support 14 through slits 78 in the latticework of the first privacy screen 16 at a lower portion 80 thereof. A first end 82 of the second support member 76 is secured to a lower end 84 of the stiffened spine 38 such that the second support member 76 provides support to the first privacy screen 16 when the first privacy screen 16 is in the deployed position 24.

Figure 13:
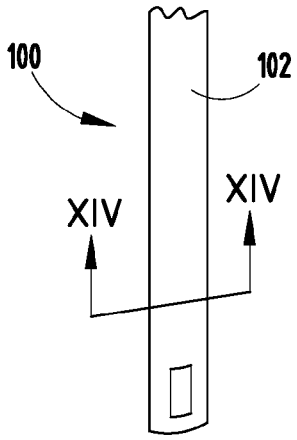
FIG. 13 is a partial top perspective view of a support member of the present invention.
Figure 14:
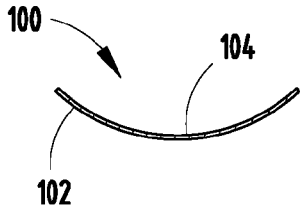
FIG. 14 is a cross-sectional view of the support member of FIG. 13, taken at line XIV-XIV.
Figure 15:
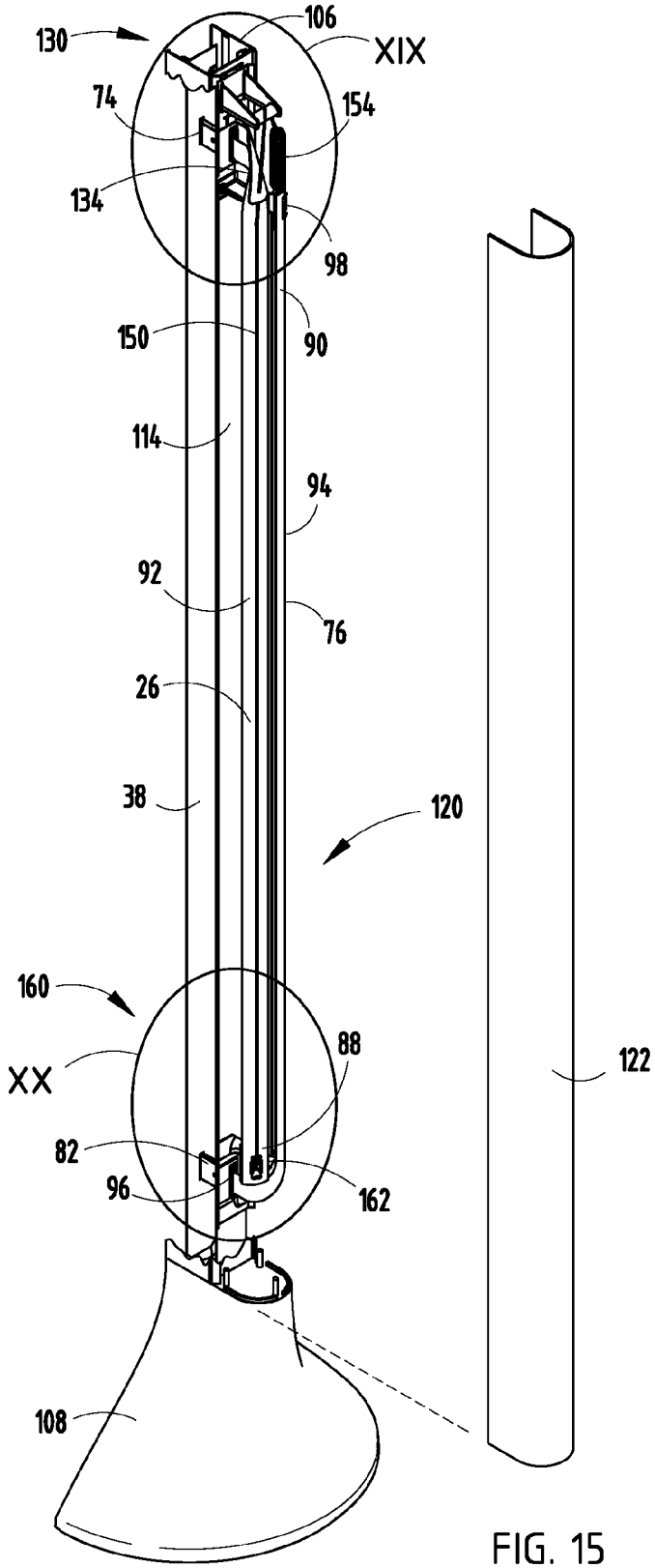
FIG. 15 is a top perspective view of the second elongated support with the support members in the retracted position and the housing removed.

Referring to FIGS. 14 and 15, the first and second support members 26, 76 each include second ends 88, 90, respectively, disposed in the second elongated support 14, and an intermediate portion 92, 94 disposed between the first ends 74, 82 and second ends 88, 90. A first stop 96 is located at the second end 88 of the first support member 26 and a second stop 98 is located at the second end 90 of the second support member 76. Each of the first and second support members 26, 76 include an arcuate tape-like construction 100 (FIGS. 13 and 14) with a convex first side 102 and a concave second side 104. This construction provides vertical and lateral strength to the first and second support members 26, 76 to carry the weight of the privacy screen 16.

As shown in FIGS. 15-18, the second elongated support 14 includes a casing 106 and a receiving base 108. The casing 106 includes an elongate cavity 110 (FIG. 18) for receiving a portion of the vertical pole 40 of the first elongated support 12. Similarly, the receiving base 108 has a base cavity 112 (FIG. 18) that is complimentary in shape to the conical exterior 50 of the base 48 of the first elongated support 12 and that is adapted to receive the base 48 when the privacy screen assembly 10 is in the retracted position 22 as shown in FIG. 2. In one embodiment, the elongate cavity 110 of the casing 106 and the base cavity 112 of the receiving base 108 of the second elongated support 14 hide from view approximately half of the first elongated support 12.

Figure 16:
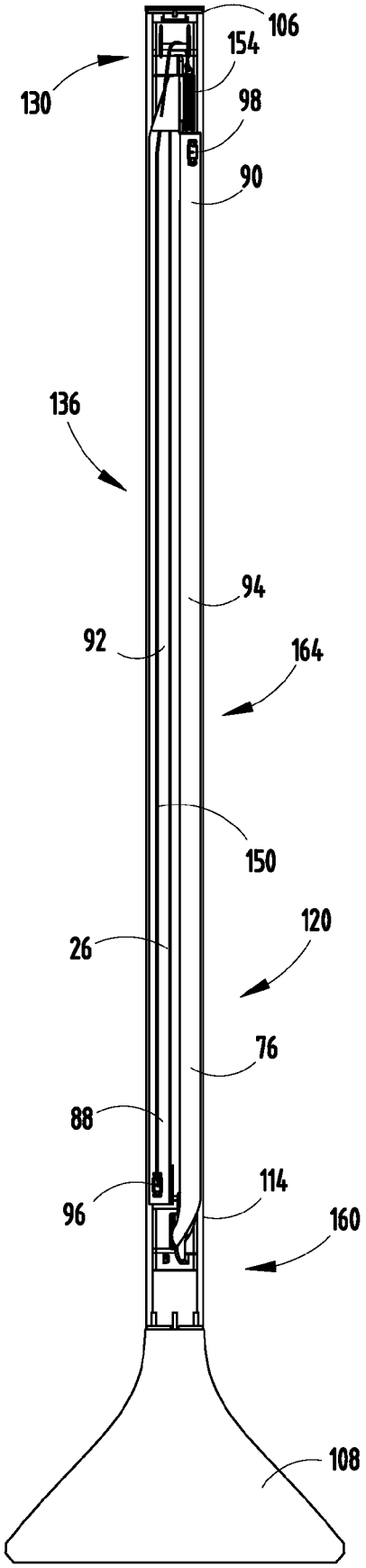
FIG. 16 is a rear elevational view of the second elongated support with the support members in the retracted position and the housing removed.
Figure 17:
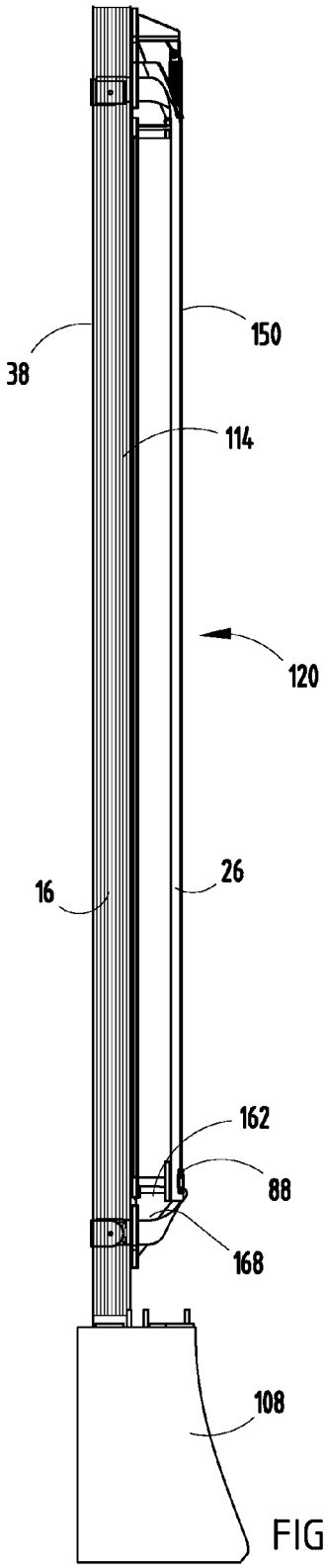
FIG. 17 is a side elevational view of the second elongated support with the housing removed.
Figure 18:
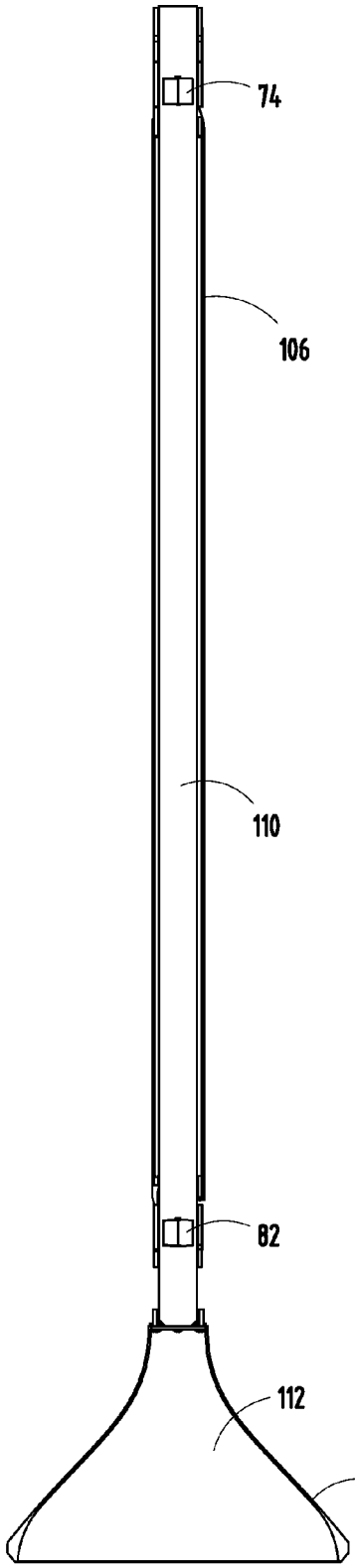
FIG. 18 is a front elevational view of the second elongated support with the privacy screen removed.

Referring now to FIGS. 15-17, the second elongated support 14 includes a support member storage device 120 that extends from a rear end 114 of the casing 106. The support member storage device 120 includes a housing 122 that covers the support member storage device 120 and protects the first and second support members 26, 76 from being damaged (FIG. 14). FIGS. 14-16 illustrate the second elongated support 14 with the first and second support members 26, 76 in the retracted position 22. The first and second support members 26, 76 will be in the retracted position 22 when the first privacy screen 16 is withdrawn into the casing 106 such that the first privacy screen 16 is in the retracted position 22.

Figure 19:
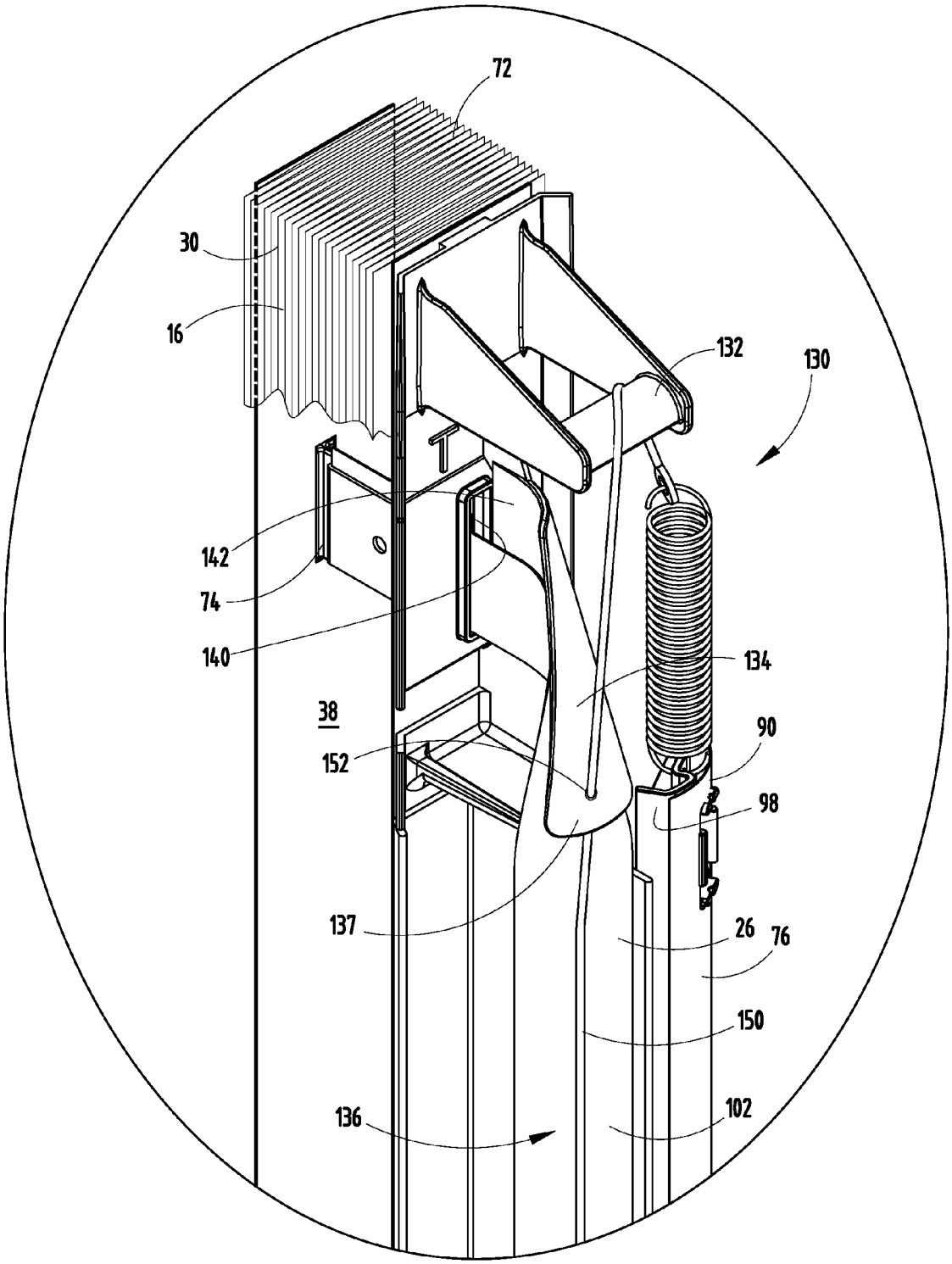
FIG. 19 is a partial top perspective view of a top portion of the second elongated support taken at line XIX of FIG. 15 with the support members retracted.

Referring to FIG. 19, a top portion 130 of the second elongated support 14 includes a pulley bar 132 that extends transverse to the longitudinal extent of the first and second support members 26, 76. A first directional translator 134 is connected with the second elongated support 14 and, during deployment, urges the first support member 26 from a substantially linear vertical retracted position 136 (FIG. 16) to a substantially linear horizontal deployed position 138 outside the housing 122 (FIG. 12). After engaging the first directional translator 134, the first support member 26 extends through an upper support aperture 140, through the slits 70 at the top portion 72 of the first privacy screen 16 and connects with the stiffened spine 38 at the first end 18 of the first privacy screen 16. The first directional translator 134 includes a forcing cone 137 having an underside 142 that engages the convex first side 102 of the first support member 26, rotating the same 90 degrees, and guiding the first support member 26 through the upper support aperture 140. During retraction of the first privacy screen 16, the first directional translator 134 aids in translating the first support member 26 from substantially linear horizontal deployed position 138 to the substantially linear vertical retracted position 136.

Referring again to FIGS. 15, 17, and 19, a tether member or cord 150 is connected to the first stop 96 on the second end 88 of the first support member 26. The cord 150 extends from the second end 88 of the first support member 26 over the pulley bar 132 and into engagement with the second stop 98 of the second end 90 of the second support member 76. The cord 150 may include shock-absorbing properties such that the cord 150 acts as a shock absorber during movement of the second elongated support 14 from the retracted position 22 to the deployed position 24 and from the deployed position 24 to the retracted position 22. The cord 150 acts to limit any tilt of the top portion 130 of the second elongated support 14 that might otherwise occur. The cord 150 acts to tether the second ends 88, 90 of the first and second support members 26, 76, respectively, and therefore forces the first and second support members 26, 76 from deploying at uneven rates. The cord may be constructed from an elastic material or may include a spring 154, or both, as shown in FIG. 19. Accordingly, the cord 150 cushions any forces acting on the first and second support members 26, 76 during deployment.

Figure 20:
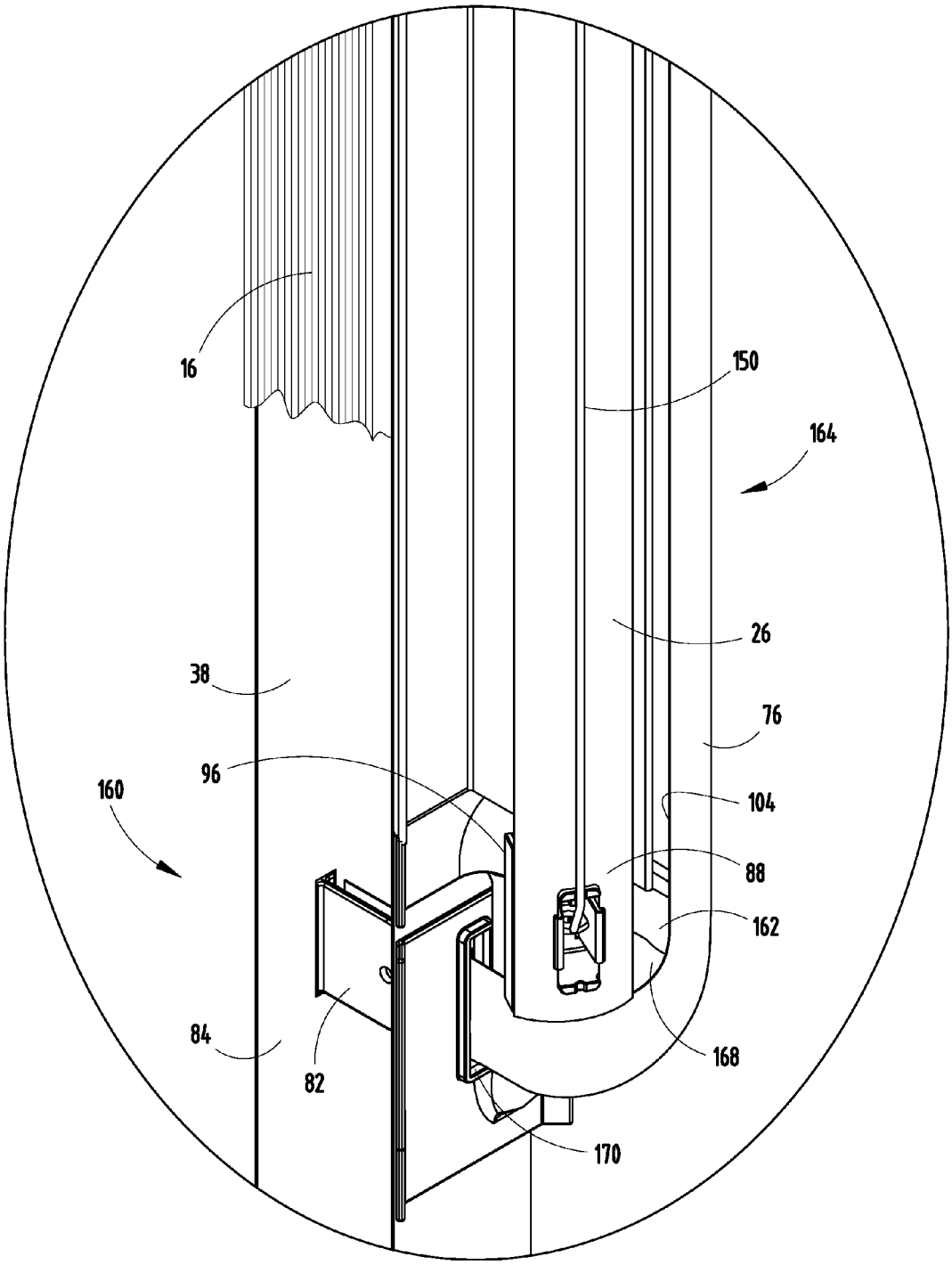
FIG. 20 is a partial top perspective view of a bottom portion of the second elongated support taken at line XX of FIG. 15 with the support members retracted.
Figure 21:
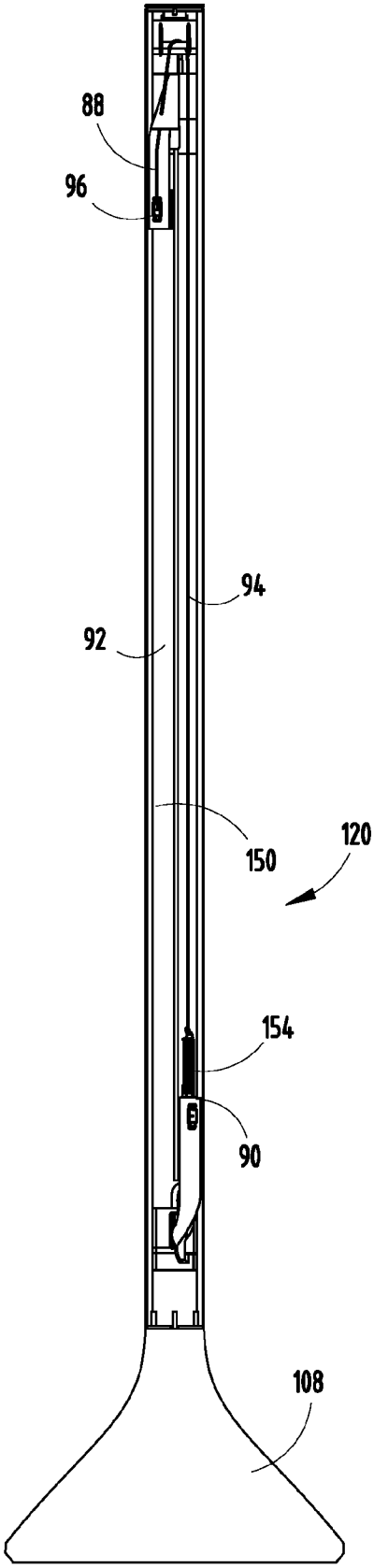
FIG. 21 is a rear elevational view of the second elongated support with the support members in the deployed position and the housing removed.
Figure 22:
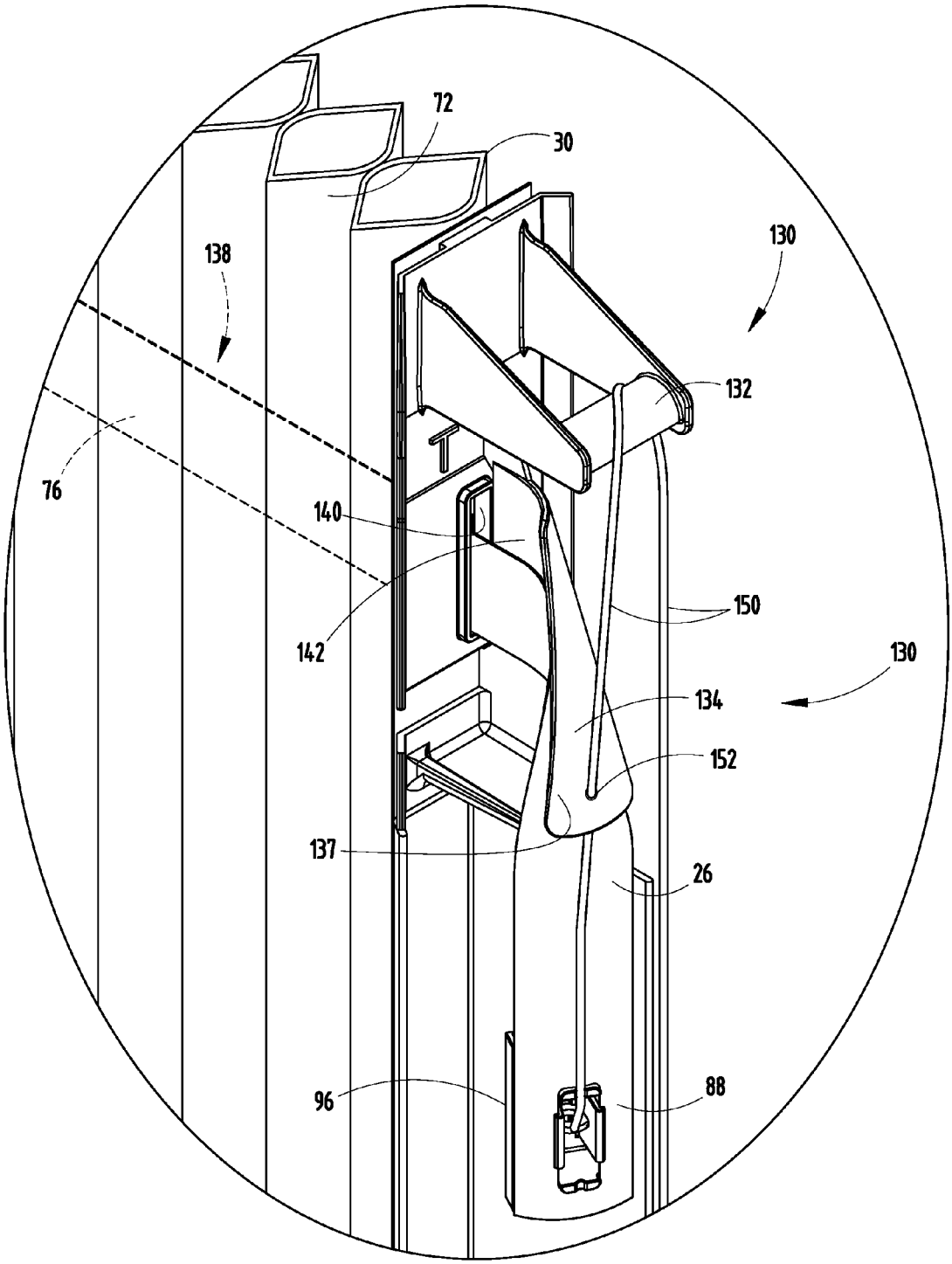
FIG. 22 is a partial top perspective view of a top portion of the second elongated support taken at line XXII of FIG. 12 with the support members deployed.
Figure 23:
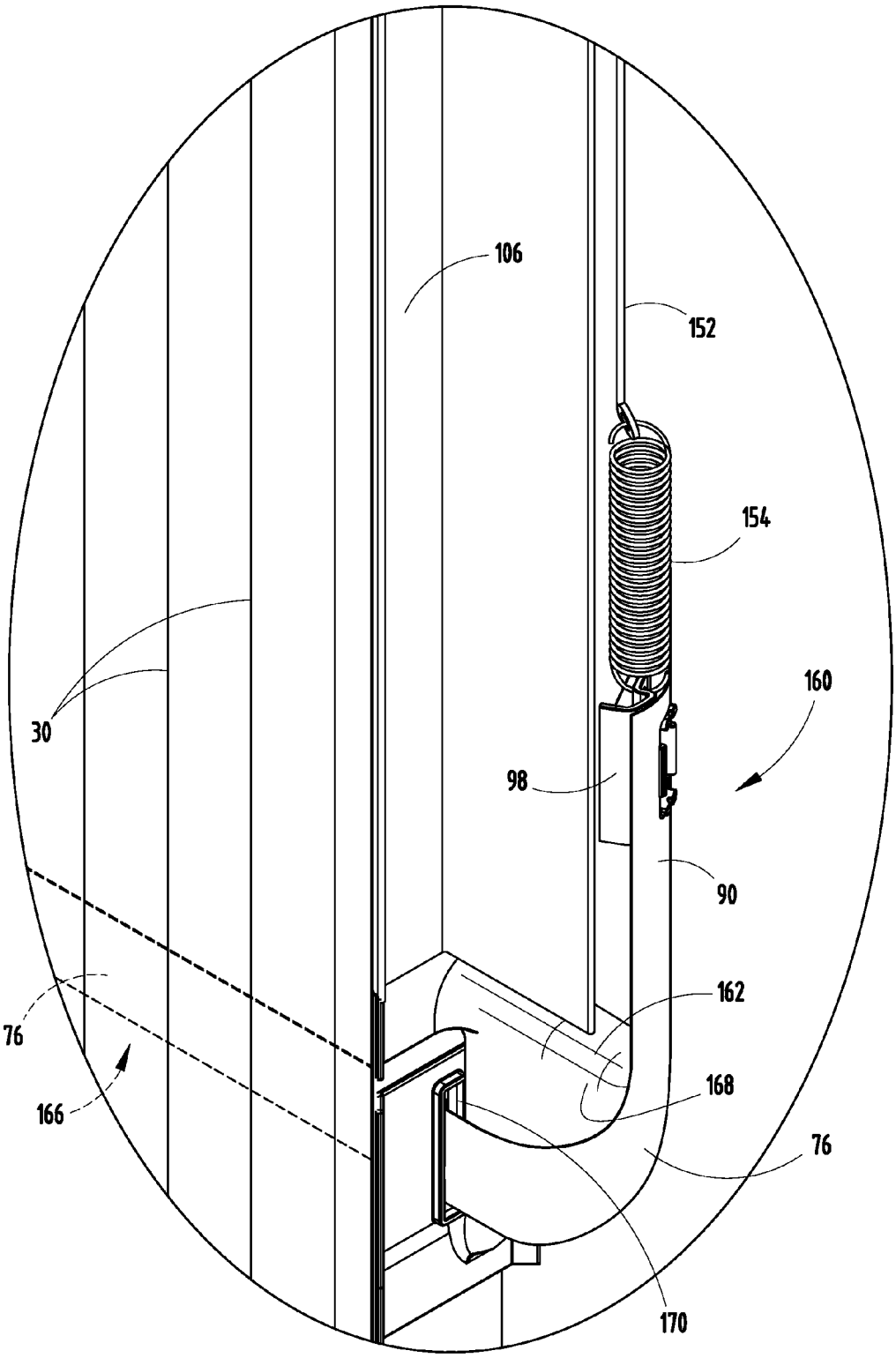
FIG. 23 is a partial top perspective view of a bottom portion of the second elongated support taken at line XXIII of FIG. 12 with the support members deployed.
Figure 24:
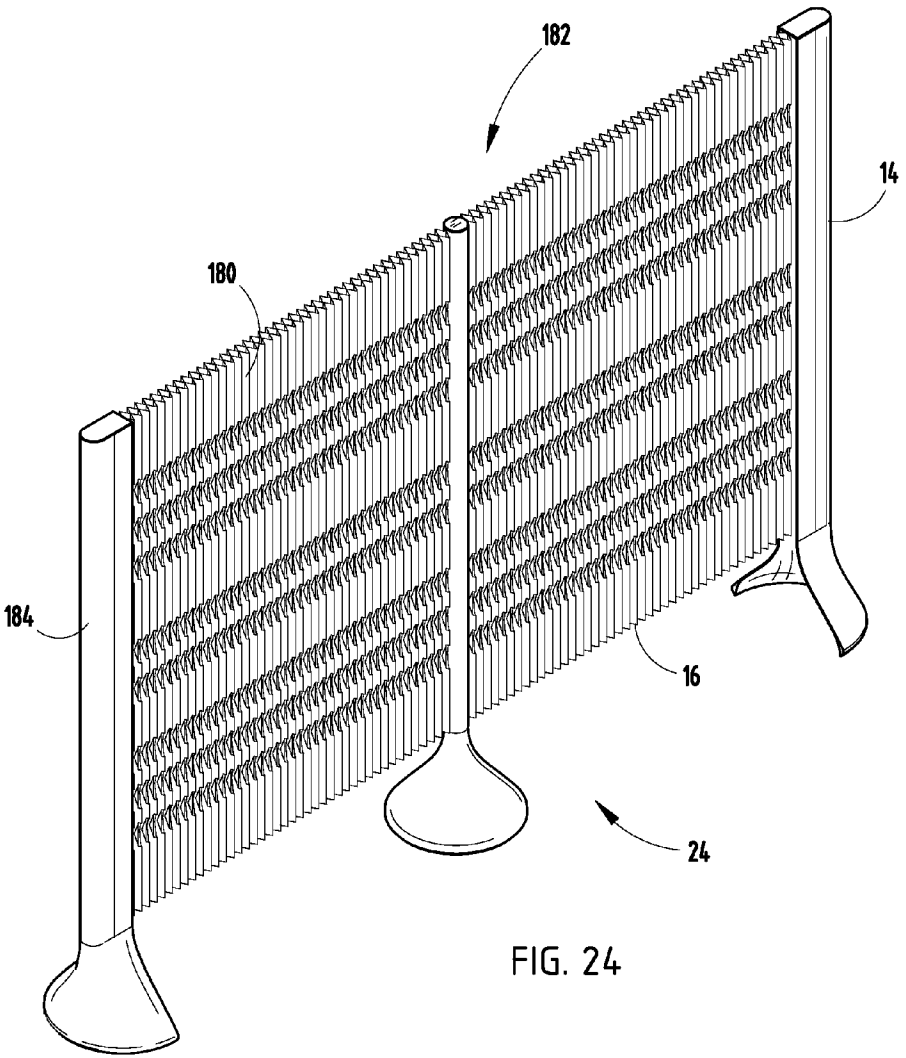
FIG. 24 is a top elevational view of another embodiment of a privacy screen assembly of the present invention with two privacy screens deployed.
Figure 25:
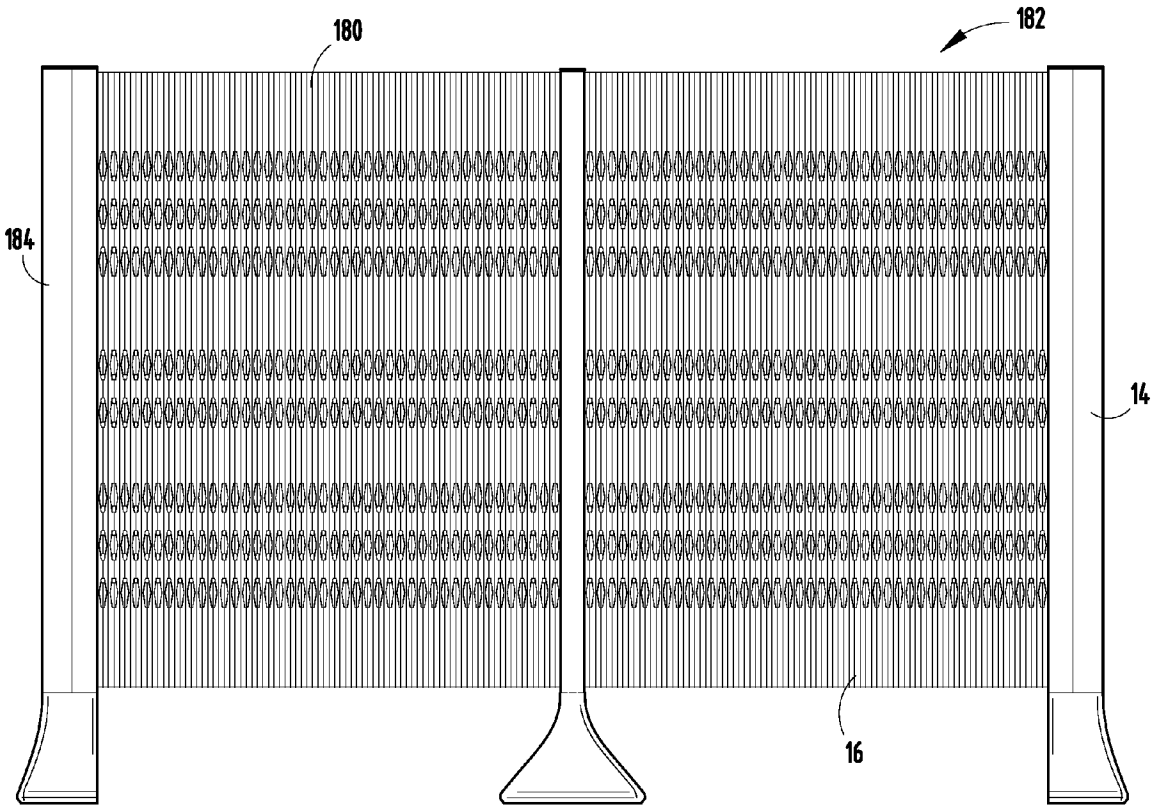
FIG. 25 is a side elevational view of the privacy screen assembly of FIG. 24.
Figure 26:
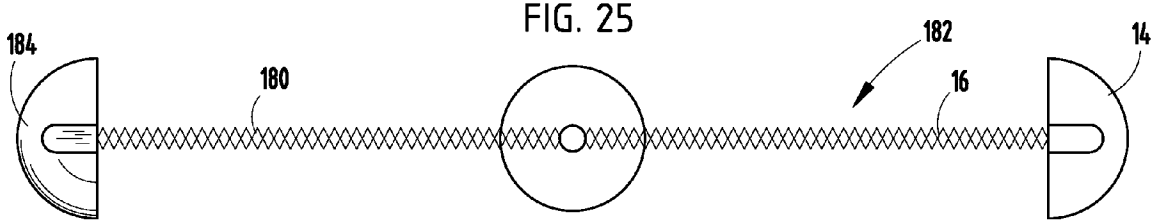
FIG. 26 is a top elevational view of the privacy screen assembly of FIG. 24.

Referring now to FIG. 20, a bottom end 160 of the second elongated support 14 includes a second directional translator 162 that urges the second support member 76 from a substantially linear vertical retracted position 164 (FIG. 16) inside the housing 122 of the second elongated support 14 to a substantially linear horizontal deployed position 166 (FIG. 12) forward of the casing 106 of the second elongated support 14. The second directional translator 162 includes a forcing wedge 168 that changes the direction of the longitudinal extent of the second support member 76 during retraction and deployment. The forcing wedge 168 engages the concave second side 104 of the second support member 76 and slides the second support member 76 to one side off of the forcing wedge 168 and into a lower support aperture 170 before exiting forward of the casing 106 of the second elongated support 14. During retraction of the first privacy screen 16, the second directional translator 136 aids in translating the second support member 76 from the substantially linear horizontal deployed position 166 to the substantially linear vertical retracted position 164.

As shown in FIGS. 21-24, when the first privacy screen 16 is in the deployed position, the first and second support members 26, 76 extend forward of the casing 106 of the second elongated support 14. During deployment, the second end 88 of the first support member 26 moves upwardly as the intermediate portion 92 of the first support member 26 exits the upper support aperture 140 and into the deployed and horizontal position 24. Similarly, the second end 90 of the second support member 76 moves downward toward the second directional translator 162 as the intermediate portion 94 of the second support member 76 extends outwardly into the horizontal and deployed position 24. The cord 150 that extends from the second end 88 of the first support member 26 over the pulley bar 132 and into engagement with the second end 90 of the second support member 76 prevents the first and second support members 26, 76 from exiting the housing 120 of the second elongated support 14 at substantially different rates. Accordingly, the top portion 92 and bottom portion 80 of the first privacy screen 16 are deployed at an equal rate, thereby minimizing any cant or tilt that might otherwise occur in the second elongated support 14.

Referring now to FIGS. 24-27, a second privacy screen 180 may be secured to the first elongated support 12 to form privacy screen assembly 182. The stiffened spine 38 of the second privacy screen 180 is designed for engagement with the other of the C-shaped channels 54, 56. The second privacy screen 180 extends from a third elongated support 184 and includes a construction that is similar to the construction of the first privacy screen 16 and second elongated support 14.

Figure 28:
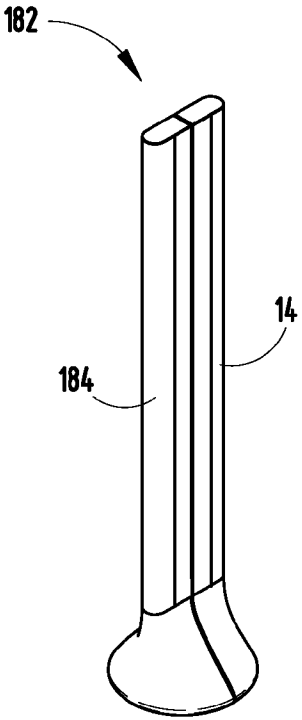
FIG. 28 is a top elevational view of the privacy screen assembly of FIG. 24, with both of the privacy screens retracted.
Figure 27:
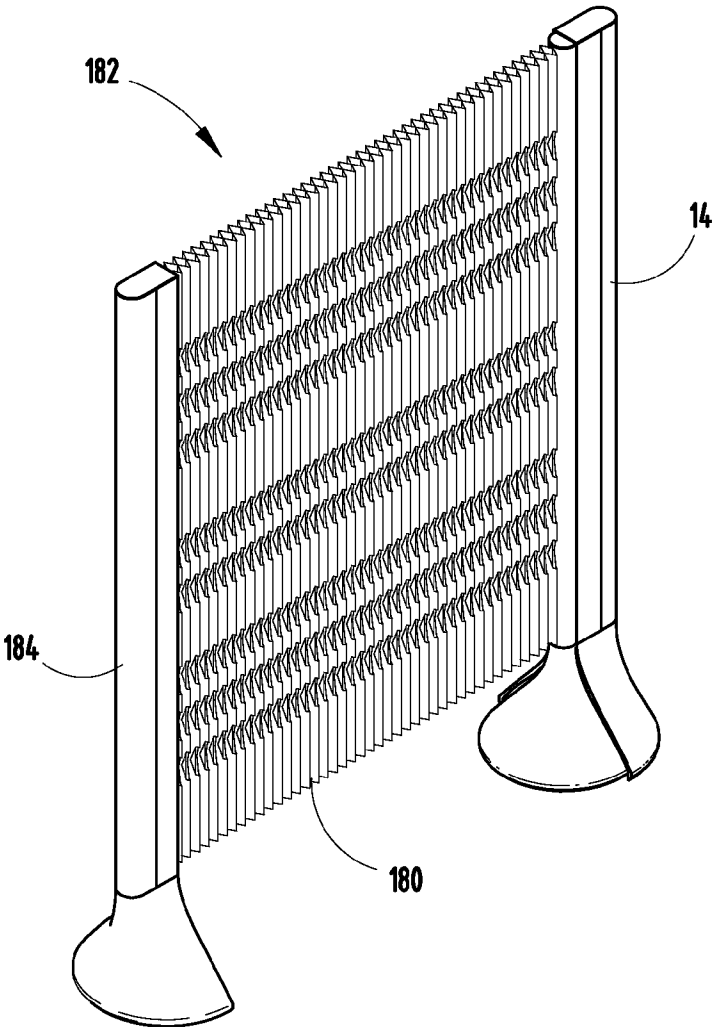
FIG. 27 is a top elevational view of the privacy screen assembly of FIG. 24, with one of the privacy screens retracted.
Figure 29:
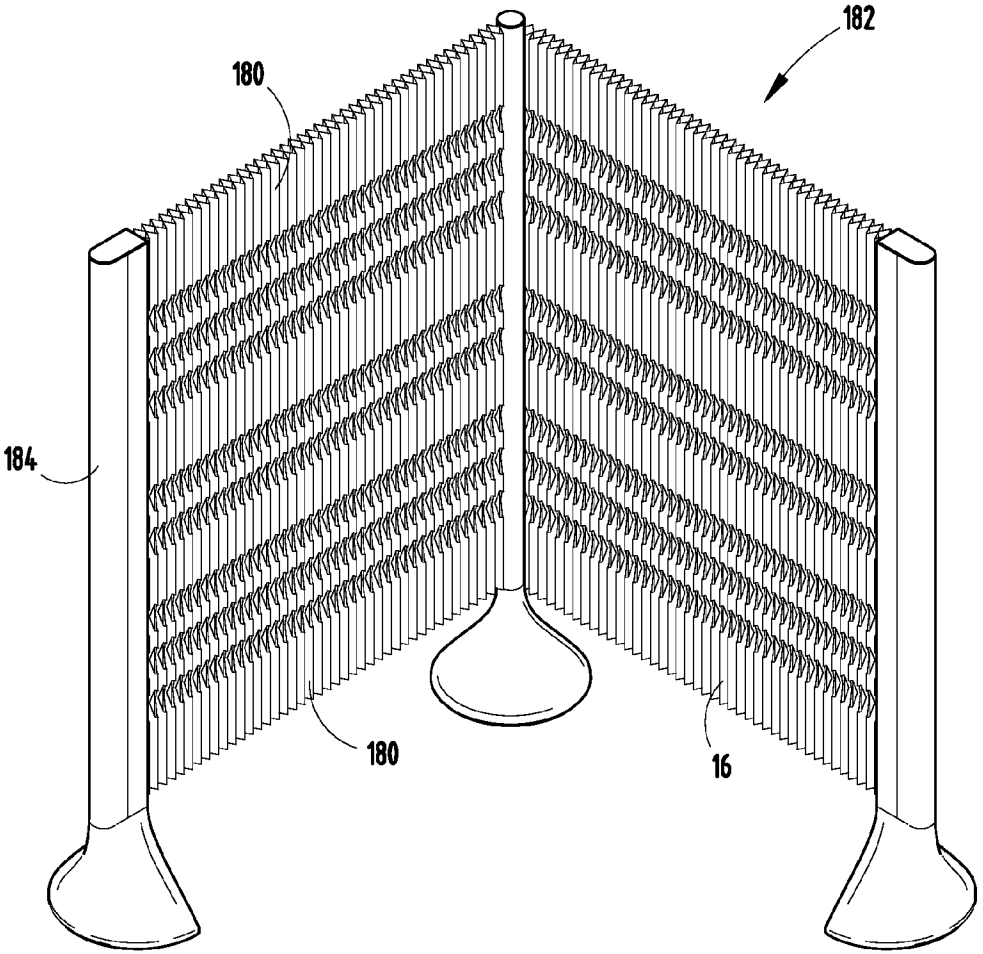
FIG. 29 is a top elevational view of the privacy screen assembly of FIG. 24, with the privacy screens angled relative to one another.

As shown in FIG. 28, when the first and second privacy screens 16, 184 are in the retracted position 22, the second and third elongated supports 14, 184 are in close proximity to the first elongated support 12 such that the first elongated support 12 is hidden from view. It is conceived that the first privacy screen 16 and second elongated support 14 and/or the second privacy screen 180 and the third elongated support 184 may be deployed or retracted in a variety of angles and lengths, one such example being shown in FIG. 29.

Figure 30:
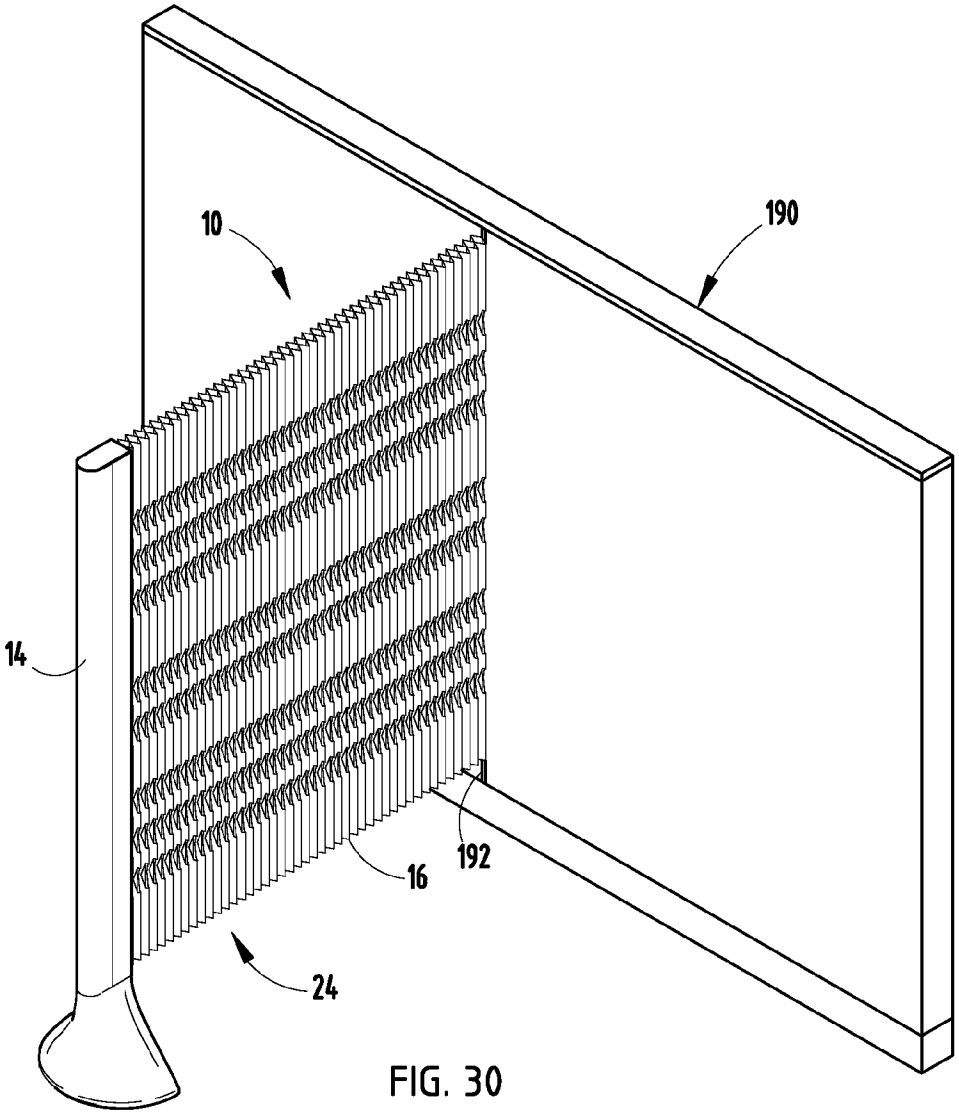
FIG. 30 is a top elevational view of the privacy screen assembly connected with a partition panel system.

Referring now to FIG. 30, in the illustrated embodiment, the privacy screen 16 extends from a partition panel assembly 190. The privacy screen 16 is positionable between deployed and retracted positions, wherein the privacy screen 16 is received inside a cavity of the second elongated support 14 when in the retracted position. It is contemplated that the stiffened spine 38 of the privacy screen 16 is receivable in an elongate vertical slot 192 disposed in the partition panel 190.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A privacy screen assembly, comprising:

a first elongated support having an enlarged support base;

a second elongated support;

a first privacy screen having a first end operably coupled with the first elongated support, and a second end operably coupled to the second elongated support;

a first support member operably received by the first privacy screen such that the first privacy screen is vertically supported by the first support member, the first support member being positionable between a retracted position, wherein the first support member is stored within an interior of a select one of the first elongated support and the second elongated support in a substantially linear configuration, and a deployed position, wherein a substantial portion of the first support member extends from the interior of the select one of the first elongated support and the second elongated support and wherein a substantial portion of the first support member exits the interior of the select one of the first elongated support and second elongated support such that less of the first support member is present in the interior of the select one of the first elongated support and second elongated support than when the first support member is in the retracted position; and an enlarged receiving base disposed on the second elongated support, wherein the receiving base includes a base cavity for receiving a portion of the enlarged support base, and wherein the second elongated support includes a cavity configured to receive therein the first privacy screen and at least a portion of the first elongated support when the first privacy screen is in the retracted position.

2. The privacy screen assembly of claim 1, wherein the base cavity of the receiving base is complementary in shape to the shape of the enlarged support base.

3. The privacy screen assembly of claim 1, further comprising:

a first directional translator in abutting contact with the first support member and adapted to redirect the first support member as the first support member is moved between the retracted position and the deployed position and between the deployed position and the retracted position.

4. The privacy screen assembly of claim 3, wherein the first directional translator includes a forcing cone that redirects the longitudinal extent of the first support member from a substantially vertical orientation inside a select one of the first elongated support and the second elongated support to a substantially horizontal orientation outside the select one of the first elongated support and the second elongated support.

5. The privacy screen assembly of claim 1, further comprising:

a second support member operably coupled with the first privacy screen such that the first privacy screen is vertically supported by the second support member.

6. The privacy screen assembly of claim 5, wherein the first and second support members each include an arcuate cross section.

7. The privacy screen assembly of claim 5, further comprising:

a second directional translator in abutting contact with the second support member and adapted to redirect the second support member as the second support member is moved between a retracted position wherein the second support member is stored within an interior of a select one of the first elongated support and the second elongated support in a substantially linear configuration, and a deployed position, wherein a substantial portion of the second support member extends from the interior of the select one of the first elongated support and the second elongated support and wherein a substantial portion of the second support member exits the interior of the select one of the first elongated support and second elongated support such that less of the second support member is present in the interior of the select one of the first elongated support and second elongated support than when the first support member is in the retracted position.

8. The privacy screen assembly of claim 7, further comprising:

a tether member operably coupled to the second support member and the first support member, wherein the tether member operably couples the first and second support member such that the first support member and second support member deploy and retract at a substantially equal rate.

9. The privacy screen assembly of claim 8, wherein the tether member comprises a shock-absorbing cord connected to the first and second support members.

10. The privacy screen assembly of claim 1, wherein the first privacy screen includes slits through which the first support member extends when in the deployed position.

11. The privacy screen assembly of claim 1, further comprising:

a third elongated support; and a second privacy screen having a first end operably coupled to the first elongated support and a second end operably coupled to the third elongated support, wherein the second privacy screen is positionable between a retracted position and a deployed position.

12. A privacy screen assembly, comprising:

a first elongated support;

a second elongated support;

a first privacy screen having a first end operably coupled with the first elongated support, and a second end operably coupled to the second elongated support;

a first support member operably received by the first privacy screen such that the first privacy screen is vertically supported by the first support member, the first support member being positionable between a retracted position, wherein the first support member is stored within an interior of a select one of the first elongated support and the second elongated support in a substantially linear configuration, and a deployed position, wherein a substantial portion of the first support member extends from the interior of the select one of the first elongated support and the second elongated support and wherein a substantial portion of the first support member exits the interior of the select one of the first elongated support and second elongated support such that less of the first support member is present in the interior of the select one of the first elongated support and second elongated support than when the first support member is in the retracted position;

a third elongated support;

a second privacy screen having a first end operably coupled to the first elongated support and a second end operably coupled to the third elongated support, wherein the second privacy screen is positionable between a retracted position and a deployed position, wherein the third elongated support includes a cavity configured to receive therein the second privacy screen and approximately half of the first elongated support when the second privacy screen is in the retracted position, such that the third elongated support and second elongated support fully enclose the first elongated support when the first and second privacy screens are in the retracted position.

13. A privacy screen assembly comprising:

a first elongated vertical support having a first enlarged base;

a privacy screen having a first end and a second end, wherein the first end is removably connected to the first elongated support and wherein the privacy screen is positionable between a retracted position and a deployed position;

a second elongated vertical support connected to the second end of the privacy screen and having a second enlarged base, wherein one of the first enlarged base and the second enlarged base includes a base cavity for receiving the other of the first enlarged base and the second enlarged base, and wherein one of the first elongated support and the second elongated support includes a cavity configured to receive therein the privacy screen and a portion of the other of the first elongated support and the second elongated support when the privacy screen is in the retracted position; and a support member assembly comprising:

a first support member slidably engaged with the privacy screen, the first support member having a substantial portion thereof stored in a vertical linear orientation when the privacy screen is in the retracted position; and a second support member slidably engaged with the privacy screen, the second support member having a substantial portion thereof stored in a vertical linear orientation when the privacy screen is in the retracted position, wherein the privacy screen is laterally supported between the first elongated vertical support and the second elongated vertical support solely by the first and second support members when the privacy screen is in the deployed position.

14. The privacy screen assembly of claim 13, wherein the first elongated support is disposed in a partition panel assembly.

15. The privacy screen assembly of claim 13, wherein the first elongated support includes a channel that removably receives a stiffened spine disposed on the first end of the privacy screen.

16. The privacy screen assembly of claim 13, wherein the first elongated support includes first and second channels, and wherein the first channel includes a portion of the privacy screen and the second channel includes a removable filler.

17. In a mobile screen assembly having an extendable and retractable screen extending between a first elongated vertical support and a second elongated vertical support, the improvement of a support member storage device, comprising:

a support member slidably connected with the privacy screen and being positionable between a linear retracted position inside the second elongated vertical support and a linear deployed position outside the second elongated vertical support;

a channel disposed in the first elongated vertical support adapted to removably receive an edge of the privacy screen;

a first directional translator connected to the elongated vertical support that is slidingly engaged with the support member and configured to translate the support member from the linear retracted position to the linear deployed position:

an enlarged support base on the first elongated support: and an enlarged receiving base disposed on the second elongated support, wherein the receiving base includes a base cavity for receiving a portion of the enlarged support base, and wherein the second elongated support includes a cavity configured to receive therein the first privacy screen and at least aportion of the first elongated support when the first privacy screen is in the retracted position.

18. The screen assembly of claim 17, wherein the support member includes first and second support members operably engaged with upper and lower portions of the privacy screen.

19. The screen assembly of claim 17, wherein the support member includes an arcuate cross section.

20. The screen assembly of claim 17, wherein the first and second elongated vertical supports include a cavity adapted to receive therein the privacy screen.

* * * * *